US010222028B2

(12) United States Patent
Hesse

(10) Patent No.: US 10,222,028 B2
(45) Date of Patent: Mar. 5, 2019

(54) WALL WASHER

(71) Applicant: ZUMTOBEL LIGHTING GMBH, Lemgo (DE)

(72) Inventor: Peter Hesse, Hessisch Oldensdorf (DE)

(73) Assignee: ZUMTOBEL LIGHTING GMBH, Lemgo (DE)

( * ) Notice: Subject to any disclaimer, the term of this patent is extended or adjusted under 35 U.S.C. 154(b) by 0 days.

(21) Appl. No.: 15/503,166

(22) PCT Filed: Oct. 15, 2015

(86) PCT No.: PCT/EP2015/073864
§ 371 (c)(1),
(2) Date: Feb. 10, 2017

(87) PCT Pub. No.: WO2016/059148
PCT Pub. Date: Apr. 21, 2016

(65) Prior Publication Data

US 2017/0234508 A1 Aug. 17, 2017

(30) Foreign Application Priority Data

Oct. 15, 2014 (DE) ..... 20 2014 104 900 U

(51) Int. Cl.
*F21V 7/04* (2006.01)
*F21V 3/04* (2018.01)
(Continued)

(52) U.S. Cl.
CPC *F21V 7/04* (2013.01); *F21S 4/28* (2016.01); *F21S 8/04* (2013.01); *F21V 3/00* (2013.01);
(Continued)

(58) Field of Classification Search
CPC ..... F21S 8/033
See application file for complete search history.

(56) References Cited

U.S. PATENT DOCUMENTS 5,115,384 A * 5/1992 Loth ..... F21V 7/0008 362/18
5,199,782 A * 4/1993 Johnson ..... F21S 8/026 362/135
(Continued)

FOREIGN PATENT DOCUMENTS

DE 29906806 8/2000
DE 102007001702 7/2008
(Continued)

OTHER PUBLICATIONS

German search report in co-pending German application 20 2014 104 900.2 dated May 13, 2015.
(Continued)

*Primary Examiner* — Andrew J Coughlin
(74) *Attorney, Agent, or Firm* — Andrus Intellectual Property Law

(57) ABSTRACT

In the case of a lighting fixture (100) with lighting means having LEDs (5) arranged one behind the other in the longitudinal direction (I) of the lighting fixture (100) and a reflector (10) which is concave in a plane perpendicular to the longitudinal direction (I) of the lighting fixture (100), the lighting means are arranged in the upper region (11) of the reflector (10) such that they emit light onto the reflector (10) in essentially the opposite direction from a light emission direction (A) of the light fitting (100), wherein a diffuser (20) is arranged below the lighting means and extends as far as the reflector (10).

14 Claims, 2 Drawing Sheets

(51) Int. Cl.

| | |
|---|---|
| ***F21V 7/00*** | (2006.01) |
| ***F21S 4/28*** | (2016.01) |
| ***F21S 8/04*** | (2006.01) |
| ***F21V 3/00*** | (2015.01) |
| ***F21V 19/00*** | (2006.01) |
| *F21Y 103/10* | (2016.01) |
| *F21Y 115/10* | (2016.01) |

(52) U.S. Cl.
CPC ..... *F21V 3/04* (2013.01); *F21V 7/005* (2013.01); *F21V 7/0008* (2013.01); *F21V 19/003* (2013.01); *F21Y 2103/10* (2016.08); *F21Y 2115/10* (2016.08)

(56) References Cited

U.S. PATENT DOCUMENTS

| | | | | |
|---|---|---|---|---|
| 5,709,460 | A * | 1/1998 | Lester | F21S 8/02 362/147 |
| 6,789,914 | B1 * | 9/2004 | Brown | F21S 8/02 362/147 |
| 7,740,387 | B2 * | 6/2010 | Schultz | F21V 7/22 362/330 |
| 8,038,327 | B1 | 10/2011 | Franck et al. | |
| 8,113,680 | B2 * | 2/2012 | O'Brien | F21S 8/026 362/147 |
| 8,240,877 | B2 * | 8/2012 | Kim | F21S 8/026 362/217.13 |
| 9,726,337 | B2 * | 8/2017 | Hedberg, Jr. | F21S 8/026 |
| 2003/0048639 | A1 * | 3/2003 | Boyd | G02B 6/0031 362/97.3 |
| 2006/0120078 | A1 | 6/2006 | Klose | |
| 2008/0204888 | A1 | 8/2008 | Kan et al. | |
| 2010/0091506 | A1 | 4/2010 | Vogel et al. | |
| 2010/0172152 | A1 * | 7/2010 | Boonekamp | F21V 7/0008 362/609 |
| 2011/0164398 | A1 * | 7/2011 | Holten | F21V 7/0008 362/84 |
| 2011/0280000 | A1 * | 11/2011 | Kwak | F21K 9/00 362/84 |
| 2013/0235589 | A1 * | 9/2013 | Ohno | F21V 7/0066 362/301 |

FOREIGN PATENT DOCUMENTS

| | | |
|---|---|---|
| DE | 102007059607 | 6/2009 |
| WO | 2014155305 | 10/2014 |

OTHER PUBLICATIONS

PCT International Search report in parent PCT application PCT/EP2015/073864 dated Nov. 17, 2015.
BrightView Technologies Data Sheet C-HE55-PE07-S-M02 for LED diffuser.

* cited by examiner

WALL WASHER

CROSS REFERENCE TO RELATED APPLICATION

The present application is the U.S. national stage application of International Application PCT/EP2015/073864, filed Oct. 15, 2015, which international application was published on Apr. 21, 2016 as International Publication WO 2016/059148 A1. The International Application claims priority to German Patent Application 20 2014 104 900.2, filed Oct. 15, 2014.

FIELD OF THE INVENTION

The present invention relates to a lighting fixture, which is intended for the use as a so-called wall washer present invention relates to a lighting fixture, which is intended for the use as a so-called wall washer.

BACKGROUND OF THE INVENTION

A wall washer is understood to be a lighting fixture that is specifically designed to illuminate a vertical surface in a room, i.e. particularly it's wall. Usually, lighting fixtures that are used for this purpose are directly hung or arranged on a horizontally oriented base surface, for example, the ceiling of a room, and are designed in terms of their light output, so that they illuminate a wall that is e.g. obliquely located below the mounting position of the lighting fixture. Compared to a lighting fixture that is primarily intended to illuminate an area that is located vertically below it, and which accordingly features a more symmetrical light output, the light distribution curve of a wall washer is designed in a more asymmetric manner.

In order to achieve this particular type of light emitting characteristic, special optics are used, by means of which the light emitted from the light source can be directed onto the wall area that is to be illuminated. In the past, reflectors have been used particularly for this purpose, since it was relatively simple to produce the desired asymmetric lateral light emission by means of these. From the prior art, a wide variety of versions for realizing such wall washer are known in this regard.

However, the prior art also reveals that the previously known solutions require that the lighting fixtures must have a certain minimum size in order that they can achieve a satisfactory illumination of the wall area. The smaller the dimensions of the lighting fixture, the more difficult it is to achieve an evenly homogeneous illumination. This presents a problem, since an uneven light distribution on the wall area that is to be illuminated is usually not acceptable, but at the same time, it is the general aim to make lighting fixtures smaller and more compact.

The objective of the present invention is thus to present a new possibility for realizing a wall washer by means of which it is possible to produce a homogeneous, evenly distributed light field on a wall area that is to be illuminated despite a relatively compact design of the lighting fixture.

This objective is achieved by means of a lighting fixture featuring the characteristics described below.

SUMMARY OF THE INVENTION

The solution according to the invention presents a combination of different measures which result in a compact design of the lighting fixture or of the wall washer on the one hand, but on the other hand make it possible to achieve even, homogeneous light distribution. As the desired illuminants are LEDs, which are aligned in a row in a longitudinal direction of the lighting fixture. The light emitted by these LEDs is not directly emitted by the lighting fixture, but is deflected back by means of a concavely shaped reflector in such a way that the light output is directed towards the side and downwards. To accomplish this, the illuminants or LEDs are arranged in such a way in the upper section of the reflector that they emit light mainly in the direction that is opposite to the light emitting direction of the lighting fixture onto the reflector.

Especially in the event where the dimensions of the lighting fixture are to be kept very compact, it has been discovered that it is not possible to achieve a sufficiently good light distribution by just these measures. Accordingly, the invention uses a diffuser that is arranged below the illuminants, which extends up to the reflector. It has been noticed that irregularities in the light distribution can be eliminated almost completely by using this additional diffuser and that a very homogeneous so-called light field is thus produced on the wall area that is to be illuminated.

According to the invention, a lighting fixture is thus presented that is made up of illuminants that feature LEDs, which are aligned in a row in a longitudinal direction. Furthermore, a reflector is presented, which is formed in a concave manner in a plane that is perpendicular to a longitudinal direction of the lighting fixture, whereby the illuminants are arranged in such a way in the upper section of the reflector that they emit light mainly in the direction that is opposite to the light emitting direction of the lighting fixture onto the reflector. Finally, according to the invention, a diffuser is arranged below the illuminants, which extends up to the reflector.

The illuminants or the LEDs are preferably completely separated from the reflector by means of the diffuser, apart from the area of the reflector which is opposite to them. In other words, the diffuser preferably extends mainly from a plane in which the illuminants are arranged, up to the reflector. The diffuser is mainly aligned perpendicular to the plane, in which the illuminants are arranged. The illuminants, the upper end section of the reflector as well as the diffuser thus encircle a small so-called mixing chamber that extends in longitudinal direction, in which the desired homogeneous light distribution is primarily performed. The light that emits from this mixing chamber via the diffuser, which is subsequently deflected by means of the reflector into the light emitting direction of the lighting fixture, can then be emitted from the lighting fixture. All light that is emitted from the lighting fixture, has thus been first affected by the diffuser, by means of which the desired even light distribution can ultimately be maintained.

The curvature of the reflector is preferably concave, and desirably the upper section, or the section to which the illuminants are associated to, features a stronger curvature than the lower section. This ensures that even light emitted by the LEDs in relatively flat angles can still be deflected efficiently by the reflector within the above-mentioned mixing chamber and can be transmitted via the diffuser into the reflector area that is actually designated for the light output of the lighting fixture.

A cover screen consisting of glass or PMMA can be arranged preferably at least in front of the bottom area of the reflector. The design of this cover screen can be made particularly in such a way that it roughly extends from the end of the diffuser that is facing away from the reflector up to the lower edge of the reflector. The cover screen can thus in particular extend mainly within the plane in which the illuminants are arranged as well.

The various components of the lighting fixture according to the invention are preferably held by a profiled base body which can be formed by e.g. an aluminum extrusion profile. This may be designed for a direct mounting onto the ceiling or also for the mounting onto a support element, e.g. onto a so-called mounting rail of a light strip system or the like.

BRIEF DESCRIPTION OF THE DRAWINGS

Below the invention will be explained in more detail with reference to the accompanying drawings. The drawings show.

DETAILED DESCRIPTION

Figure 1:
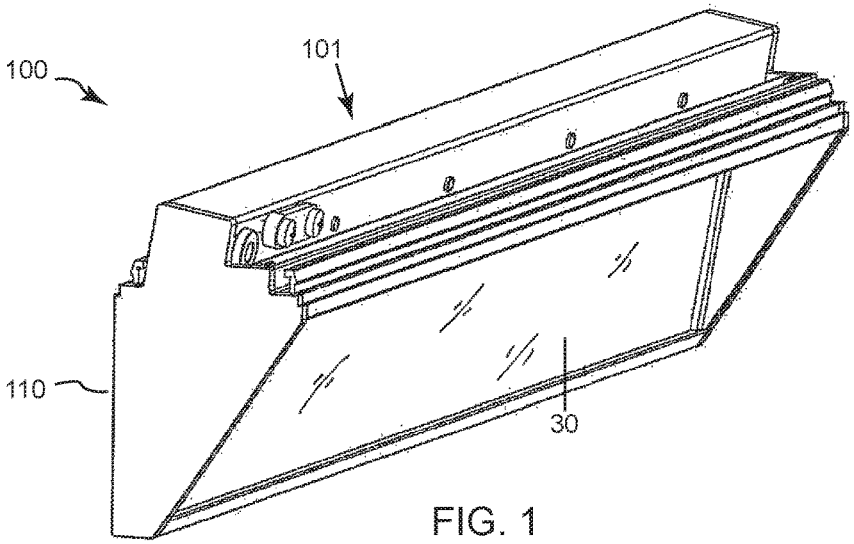
FIG. 1 is an embodiment of a wall washer according to the invention in a perspective view.

FIG. 1 illustrates an overall depiction of a lighting fixture according to the invention with the reference number 100, which is to be used as a so-called wall washer, as mentioned above. As is the case with lighting fixtures of this kind, these are attached to a horizontal mounting surface, for example to the ceiling of a room or in a comparable way. In the orientation that is intended for the operation of it, this means that the rear side (reference no. 110 in FIG. 1) of the housing 101 is essentially aligned in a vertical direction. The light of lighting fixture 100 is thereby not emitted horizontally or vertically downwards, but rather obliquely towards the side, so that in the case that the lighting fixture is arranged within the vicinity of a wall, the wall area that is located obliquely below will be illuminated. As it is generally common in the lighting technology, it is hereby intended that the so-called light field that is to be illuminated on the wall, features a brightness that is as evenly homogeneous as possible. Special measure with regard to the light output are responsible for this, as will be explained in more detail below in reference to further figures.

It is thus essential for the lighting fixture 100 according to the invention, that the light emitted by the lighting fixture not be directed straight onto the wall that is to be illuminated, but that it is rather emitted indirectly in line with a so-called back reflection. In the present case, LEDs 5 are used as illuminants, which are aligned in a row in a longitudinal direction I of the lighting fixture 100 and which are aligned in such a way that their light is primarily emitted in the direction that is opposite to the main emitting direction A of lighting fixture 100. The arrangement of the LEDs 5 is thus accomplished by means of one or more circuit boards 6, which are preferably aligned in a slightly tilted way with regards to the vertical that is defined by the rear side 101 by an angle $\alpha$ of about 10° to 20°, approximately 15°.

The light that is emitted by the LEDs 5 in the direction of the light emitting direction A of lighting fixture 100 is actually deflected by means of a reflector 10, which extends from a lower section of the lighting fixture housing 101 up to an area that is just above the LEDs 5. This reflector 10, that is designed in a fixed manner within the longitudinal direction I of lighting fixture 100, features a concave shape in a plane that is perpendicular to the longitudinal direction I, whereby it could be designed in a way that it is correspondingly slanted for this purpose, but preferably in a continuously concavely shaped manner, as it is depicted. Reflector 10, which is preferably made of a highly reflective material, thus serves as a so-called back reflector in order to emit the light obliquely sideways towards the bottom side.

However, experiments have shown that in the case of a compact design of the lighting fixture 100, the function of reflector 10 as such is not sufficient to ensure a satisfactorily homogeneous illumination. To improve the result of the illumination, an additional optical element in the form of a diffuser 20 is used in accordance with the invention, which is arranged just below the LEDs 5 according to the depictions. This diffuser 20 is preferably aligned approximately at a right angle to the mounting surface for the LED circuit boards 6, and extends from the LED circuit boards 6 up to the reflector surface. As it can be seen, the LED circuit boards 6, the diffuser 20, as well as the upper end section 11 of reflector 10 thus enclose a roughly quarter-circle-shaped or quarter-elliptical-shaped cavity in cross section, which serves as the so-called mixing chamber 25 to optimize the light output of the lighting fixture 100 according to the invention. This is particularly achieved in that all light beams, which are ultimately deflected via the area of reflector 10 that is below the diffuser 20 and which are emitted in the beam direction A of the lighting fixture, are affected at least once by means of diffuser 20. Since a large portion of the light is furthermore already deflected earlier on by the upper section 11 of reflector 10, an optimal mixing of the light rays is actually accomplished in such a way that the LEDs 5 are dissolved as individual light sources and any other irregularities are compensated as well. Thus, the quality of the light output of lighting fixture 100 is ultimately improved in a remarkable way by means of the use of the additional diffuser 20.

Figure 3:
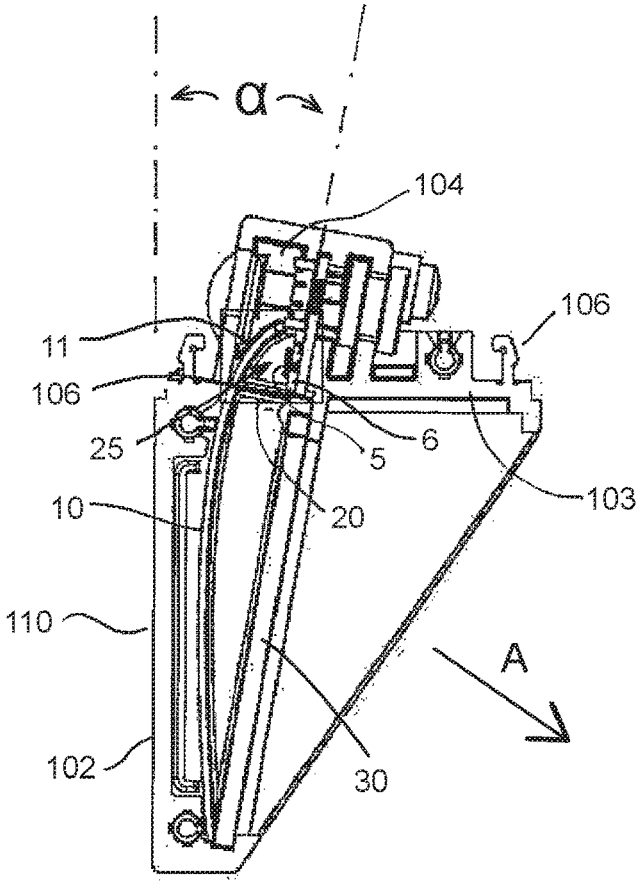
FIG. 3 is a further sectional view of the wall washer.

As it can be derived in particularly from the sectional view of FIG. 3, reflector 10 does not feature a constant curvature across the height of the lighting fixture 100, but rather is preferably shaped in such a way, that the bend in the upper section 11, or in the area that is in close vicinity of the LEDs 5, features the strongest curvature. In this way, it is possible to keep the dimensions of mixing chamber 25 relatively compact on the one hand, and on the other hand it also ensures that light, which is emitted by the LEDs 5 in relatively flat angles e.g. vertically upwards, can still be efficiently deflected back by the reflector towards the diffusor 20 and can be utilized as useable light for the light output of lighting fixture 100. The curvature of reflector 10 in the section below diffuser 20 is then selected in such a way, that the desired shape or dimension of the light field on the wall that is to be illuminated, can be achieved by it.

Figure 2:
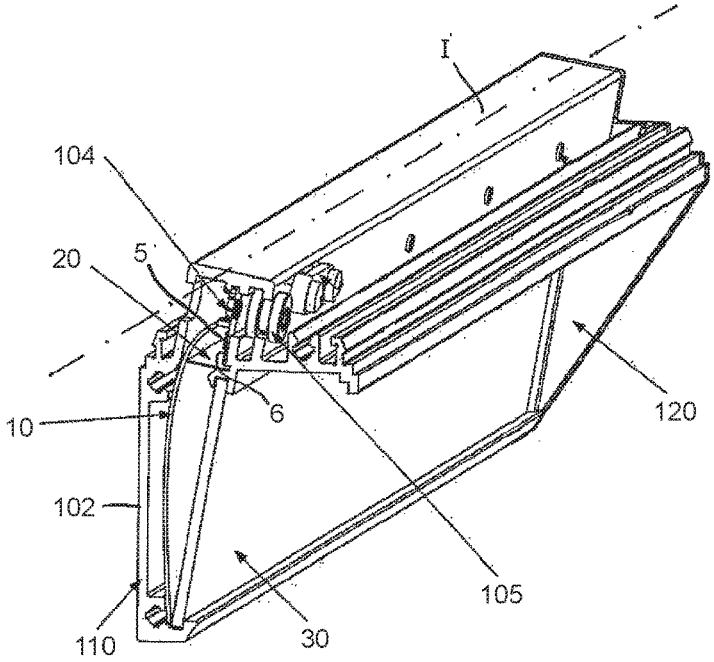
FIG. 2 is a perspective sectional view of the wall washer according to the invention, from which the alignment of the various components for the light output can be derived.

As it can be derived from the two depictions in the FIGS. 2 and 3, an additional cover screen 30 is hereby arranged in front of the bottom area of the reflector, which extends from the lower end of reflector 10 up to diffuser 20. This cover screen 30 defines the actual light output area of lighting fixture 100, although it only has a relatively little effect on the light output itself, since it is preferably designed in a transparent manner and is therefore made from either glass or PMMA. The actual light emitting characteristics of lighting fixture 100 are primarily defined by the alignment and design of reflector 10 as well as of diffuser 20.

Diffuser 20 is preferably made by means of a diffuser foil, which ideally features at least a certain degree of stability, so that it retains its shape and alignment in the depicted manner. A foil that is marketed under the name Brightview Foil Circular 15 Degrees has proven to be particularly advantageous for this purpose, since it is possible to achieve particularly advantageous light emitting characteristics by the use of this foil. This is also true in the case that the lighting fixture features a very compact design of approximately 40×50 mm.

The mounting and aligning of the different components of lighting fixture 100 according to the invention is preferably accomplished as mentioned beforehand by means of an aluminum extrusion profile, the configuration of which can be derived from the sectional views of the FIGS. 2 and 3. This profile component is designed in a slightly tilted manner and features on the one hand a side piece 102 that is aligned vertically, which composes the rear side 110 of lighting fixture 100, as well as a horizontal side piece 103, which is used in particular also for the mounting of electronic components for the operation of the LEDs 5, as well as for fitting lighting fixture 100 onto an appropriate carrier. In the upper section of the profile component, an approximately trapezoidal-like mounting space 104 is formed for this purpose, into which the reflector 10 with its upper end section 11 reaches from below on the one side, and which also serves to accommodate the LED circuit boards 6. At the same time, equipment for the operation of the LEDs 5 is possibly also arranged within this mounting space. This can also particularly refer to a converter or the like, whereby the side walls of this mounting space 104 also feature holes or penetrations 105 in order to supply cables or the like.

The aluminum profile body is hereby equipped with several grooves or channels that run in longitudinal direction, which allow a simple insertion of the above-mentioned optical components. It can be seen for example, that the upper and lower ends of cover screen 30 are accommodated within respective grooves that run in longitudinal direction, so that it can be easily slid into the profile component from one end face. The accommodation and mounting of reflector 10 is performed in a comparable manner, which rests on the profile component on its upper and lower end, and additionally also on its rear side. By means of an appropriate design of the aluminum profile component, it is possible to accomplish that the reflector independently takes the depicted shape when it is inserted. Finally, the mounting of diffuser 20 also occurs within a corresponding recess of the profile component which extends in longitudinal direction, so that—apart from the LED circuit boards 6—all essential components of lighting fixture 100 can be fitted onto the profile component without any additional mounting brackets.

After all components have been arranged within the profile component, it can be closed on its end faces by means of two correspondingly shaped end caps 120. Two further channels in longitudinal direction can e.g. be arranged for this purpose, which makes it possible that the end caps 120 can be placed on and securely mounted on the profile component.

Figure 4:
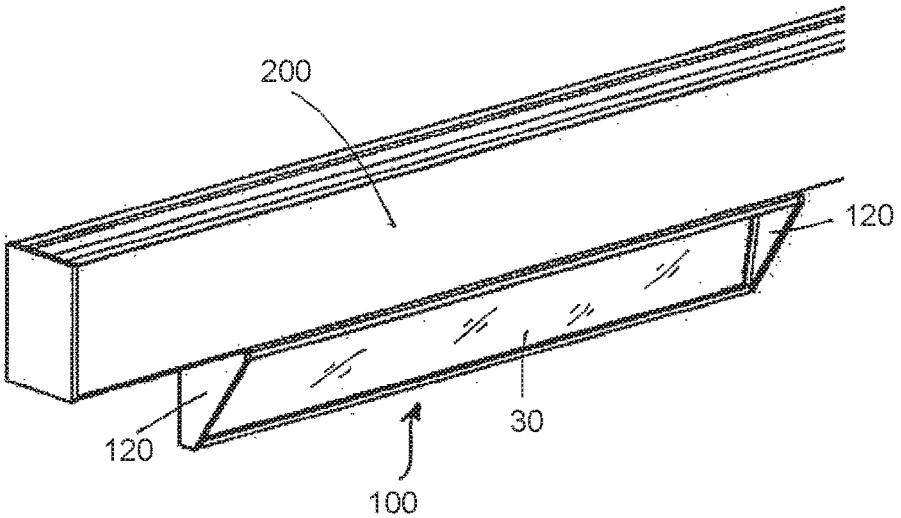
FIG. 4 is the arrangement of the wall washer according to the invention fitted to the mounting rail of a light strip system.

A possible arrangement of the wall washer 100 according to the invention on a carrier is shown in FIG. 4, whereby the mounting rail of a light strip system is hereby used as mounting element 200. In the well-known manner, the mounting rail is hereby formed in an approximate u-shape and is open towards the bottom side, so that the lighting fixture 100 can be easily fitted and attached onto mounting rail 200 from the bottom side. The upper components, in particular the above-mentioned accommodation space 104 of the profile component with the operating equipment attached to it, are then housed within the accommodation space of mounting rail 200. Attachment to mounting rail 200 is achieved by two clamping bars 106, which are formed at the upper section of the horizontal side 103 of the profile component. As an alternative to the illustrated embodiment, it would of course also be possible to shape the lighting fixture in such a way that it can be fitted directly to the lower side of a ceiling.

What is claimed is:

1. A lighting fixture comprising:

a profile component adapted to mount the lighting fixture to a downward facing, horizontal mounting surface or a carrier on the horizontal mounting surface;

LED illuminants that are aligned in a row in a longitudinal direction of the lighting fixture and face angularly upward when the lighting fixture is mounted with the profile component to the horizontal mounting surface or a carrier on the horizontal mounting surface;

a reflector, which is concavely shaped in a plane perpendicular to the longitudinal direction of the lighting fixture;

a diffuser arranged below the LED illuminants and extending up to the reflector, where an upper section of the reflector is above the diffuser and a lower section of the reflector is below the diffuser; and a transparent cover screen arranged in front of the lower section of the reflector such that light reflected from the lower section of the reflector is emitted from the lighting fixture through the transparent cover screen obliquely downward to the side in a light emitting direction, wherein the cover screen extends from the end of the diffuser located away from the reflector to a lower edge of the reflector;

whereby the LED illuminants are arranged across from the upper section of the reflector to emit light onto the reflector mainly in the opposite direction to the light emitting direction of the lighting fixture.

2. The lighting fixture according claim 1, wherein the diffuser extends substantially from a plane, in which the LED illuminants are arranged, up to the reflector.

3. The lighting fixture according claim 1, wherein the diffuser is aligned perpendicular to the plane, in which the LED illuminants are arranged.

4. The lighting fixture according claim 1, wherein the upper section of the reflector features a stronger curvature than the lower section.

5. The lighting fixture according to claim 1, wherein the cover screen consists of glass or PMMA.

6. The lighting fixture according claim 1, wherein the transparent cover screen lies essentially in the same plane in which the LED illuminants are arranged.

7. The lighting fixture according claim 1, wherein the LED illuminants are on an LED circuit board that is mounted at an angle $\alpha$ with respect to a vertical plane such that the LED illuminants face angularly upward with respect to the vertical plane when the lighting fixture is mounted to a horizontal mounting surface.

8. A lighting fixture to illuminate a vertical surface in a room comprising:

a profile component adapted to mount the lighting fixture to a downward facing, horizontal mounting surface or a carrier on the horizontal mounting surface in the vicinity of a vertical surface in a room;

LED illuminants aligned in a row in a longitudinal direction of the lighting fixture, wherein the LED illuminants are on an LED circuit board that is mounted at an upward angle $\alpha$ of about 10° to 20° with respect to a vertical plane when the lighting fixture is mounted to the horizontal mounting surface such that the LED illuminants face angularly upward with respect to the vertical plane;

a reflector which is concavely shaped in a plane perpendicular to the longitudinal direction of the lighting fixture;

a diffuser arranged below the LED illuminants and extending up to the reflector, wherein an upper section of the reflector is above the diffuser and a lower section of the reflector is below the diffuser, and the space between the LED circuit board, the upper section of the reflector and the diffuser is a light mixing chamber; and a transparent cover screen arranged in front of the lower section of the reflector such that light is emitted obliquely downward to the side from the lighting fixture in a light emitting direction through the transparent cover screen in order to illuminate the vertical surface in the room;

whereby the LED illuminants emit light into the mixing chamber and onto the upper section of the reflector mainly in an opposite direction to the light emitting direction, and the light emitted through the transparent cover screen first passes through the diffuser and is reflected by the lower section of the reflector.

9. The lighting fixture according claim 8, wherein the diffuser extends substantially from a plane in which the LED circuit board is mounted up to the reflector.

10. The lighting fixture according claim 8, wherein the diffuser is aligned perpendicular to the plane in which the LED circuit board is mounted.

11. The lighting fixture according claim 8, wherein the upper section of the reflector has a stronger curvature than the lower section.

12. The lighting fixture according to claim 8, wherein the transparent cover screen consists of glass or PMMA.

13. The lighting fixture according claim 8, wherein the transparent cover screen extends from the end of the diffuser located away from the reflector to a lower edge of the reflector.

14. The lighting fixture according claim 8, wherein the transparent cover screen lies in essentially the same plane in which the LED circuit board lies.

* * * * *